US006089482A

United States Patent [19]

Chang

[11] Patent Number: 6,089,482

[45] Date of Patent: Jul. 18, 2000

[54] BLADE ASSEMBLY FOR PAPER SHREDDERS

[76] Inventor: Frank Chang, 5th Fl., No. 11, San-Nin St., San-Chung City, Taipei Hsien, Taiwan

[21] Appl. No.: 09/330,996

[22] Filed: Jun. 14, 1999

[51] Int. Cl.[7] ..... B02C 18/06; B02C 18/18

[52] U.S. Cl. ..... 241/236; 241/291; 241/295

[58] Field of Search ..... 241/100, 236, 241/291, 293, 294, 295, 300

[56] References Cited

U.S. PATENT DOCUMENTS

| | | | |
|---|---|---|---|
| 2,658,262 | 11/1953 | Clements | 241/236 |
| 5,163,629 | 11/1992 | Raterman et al. | 241/236 |
| 5,236,139 | 8/1993 | Radtke | 241/236 |
| 5,511,729 | 4/1996 | Husain | 241/46.01 |
| 5,560,552 | 10/1996 | Powell et al. | 241/100 |
| 5,639,035 | 6/1997 | Maugle et al. | 241/236 |
| 5,676,321 | 10/1997 | Kroger | 241/236 |
| 5,788,169 | 8/1998 | Koenig | 241/236 |

*Primary Examiner*—John M. Husar

*Attorney, Agent, or Firm*—Dougherty & Troxell

[57] ABSTRACT

A blade assembly for paper shredders includes a plurality of blades arranged in a series on a rotary shaft. Each of the blades has a central hole and is integrally formed to have long and short projecting plates projecting from opposed sides thereof, respectively. The height of the long and short projecting plates is slightly larger than the thickness of the blade. The central hole of the blade can allow passage of the rotary shaft, which is configured to be polygonal. The long projecting plates of each blade bend towards the central hole to form engaging portions for engaging angular portions of the rotary shaft. The short projecting plates also bend towards the central hole to form retaining portions for engaging planer portions of the rotary shaft. The blades are arranged on the rotary shaft to form a bladed shaft such that the long and short projecting plates of one blade are in register and abut the long and short projecting plates of adjacent blades, thereby defining alternately arranged irregular intervals between the blades. When adapted for use in paper shredders, two bladed shafts are stacked to achieve alternate cutting of paper, thereby eliminating use of partition rings, reducing costs, and enhancing assembly efficiency.

2 Claims, 5 Drawing Sheets

BLADE ASSEMBLY FOR PAPER SHREDDERS

BACKGROUND OF THE INVENTION (a) Field of the Invention

The present invention relates to a blade assembly for paper shredders, more particularly to a blade assembly that eliminates use of partition rings, reduces cost, and enhances assembly efficiency.

(b) Description of the Prior Art

Paper shredders are common office machines. As they have become more and more compact in size, they are used in the home. In general, a paper shredder is provided with a blade assembly that includes two bladed shafts that opposedly rotate in a downward direction so that paper fed into the paper shredder is cut into fine strips to destroy contents of the paper. The shredded paper can be easily compressed to facilitate subsequent disposal. Aside from a housing and a drive motor, the most important component of the paper shredder is the blade assembly. With reference to FIG. 1, a conventional blade assembly includes a pair of intersecting bladed shafts 1 in a juxtaposed manner. The blades 11 of the bladed shafts intersect such that every pair of intersecting blades can achieve a balanced cutting effect. With reference to FIG. 2, the blades 11 are arranged on a polygonal drive shaft 14 and spaced apart by long partition rings 12 and short partition rings 13 to form the bladed shaft 1.

In the above-mentioned bladed shaft, the difference in length of the long and short partition rings 12, 13 is very small (about the thickness of two blades 11 and generally in the range of 1 mm). Hence, it is different for workers to identify which is which. To solve this problem, some manufacturers use colors or size of the diameter to facilitate identification of the long and short partition rings. In terms of precision and quality whether they are made of metal of plastics, the long and short partition rings 12, 13 have to be precisely controlled to obtain surface precision particularly precise thickness. If their surface is not even or the thickness is not right, the length of the blade assembly and the interval between adjacent blades after assembly will not be correct, which may affect the assembly of the bladed shafts in an intersecting manner.

In the conventional blade assembly, the blades 11 on the polygonal drive shaft 14 are spaced apart by the long partition rings 12 and the short partition rings 13 alternately. It can therefore be seen that the conventional blade assembly is more complicated in terms of structure and parts. In case any of the parts malfunction, the entire bladed shaft will become loosened and cannot work properly.

SUMMARY OF THE INVENTION

A primary object of the present invention is to provide a blade assembly for paper shredders that is simple in construction and that reduces costs, enhances assembly efficiency and precision, and reduces trouble rate.

According to a preferred embodiment of a blade assembly for paper shredders of the present invention, each of the blades has a central hole and is integrally formed to have long and short projecting plates projecting from opposed sides thereof, respectively. The blades are arranged on the rotary shaft such that the long and short projecting plates of one blade are in register and abut the long and short projecting plates of adjacent blades to achieve long and short intervals among the blades in an alternate manner, thereby eliminating use of long and short partition rings.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
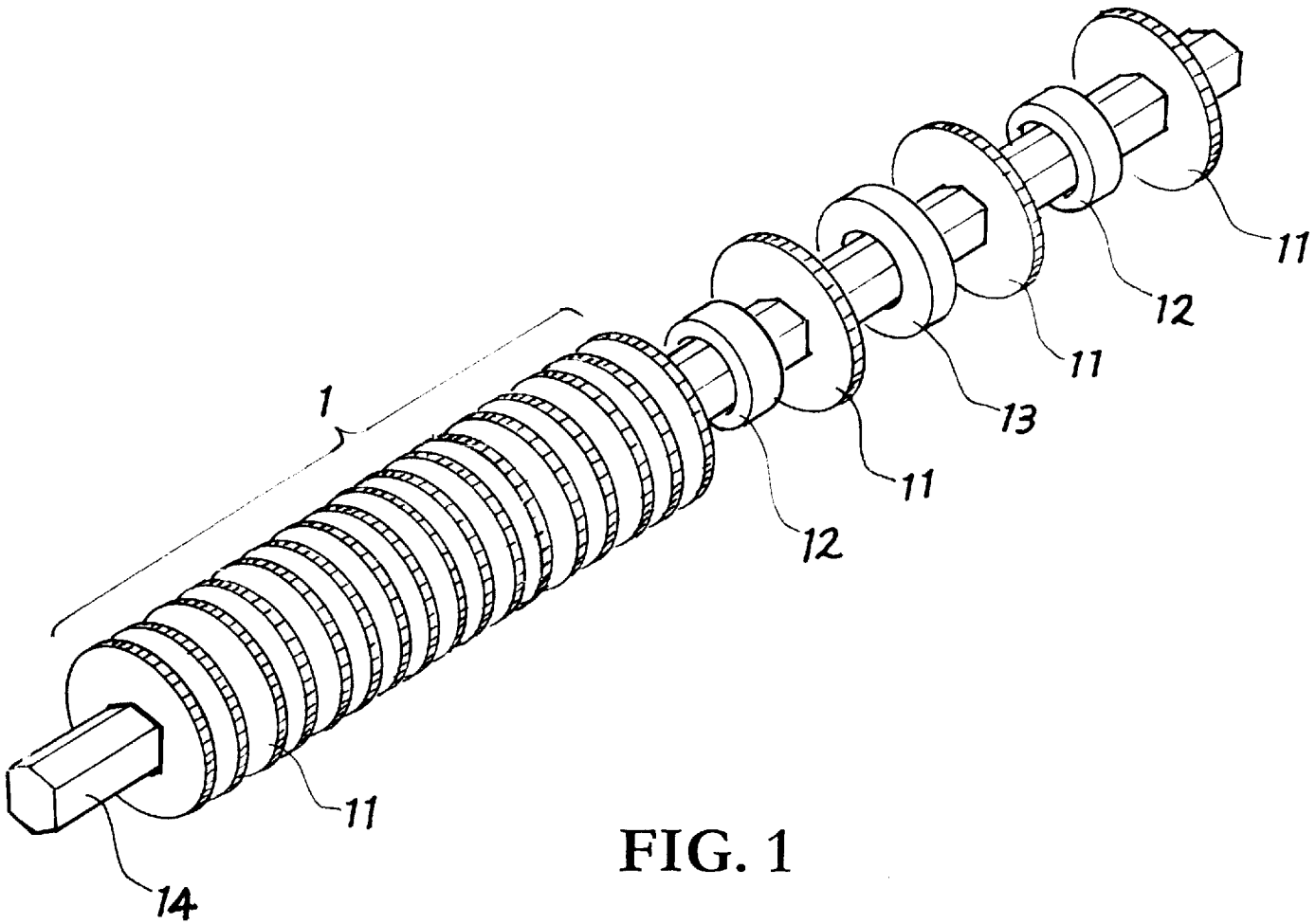
FIG. 1 Prior Art
FIG. 1 is a perspective view of a conventional blade assembly.
Figure 2:
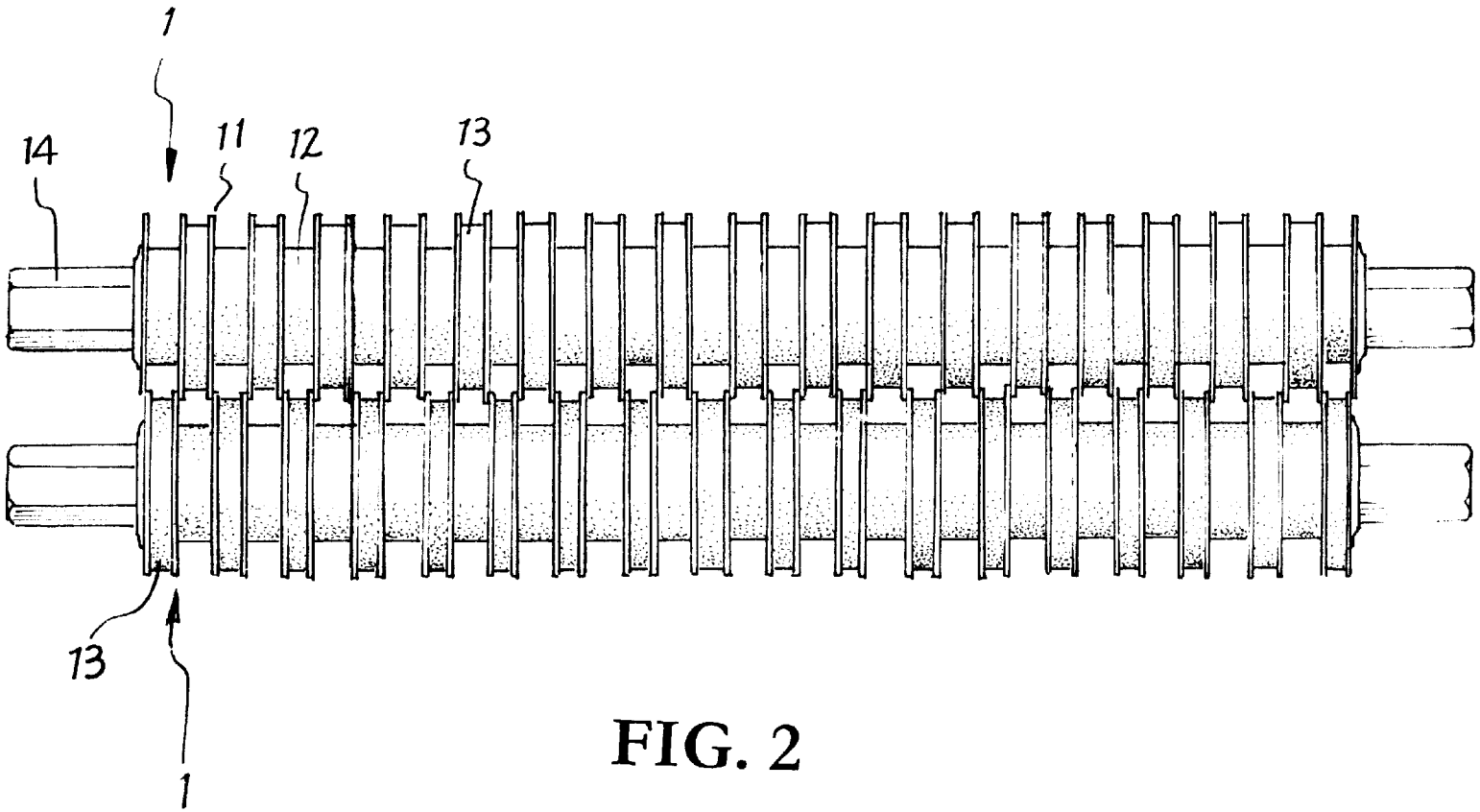
FIG. 2 Prior Art
FIG. 2 is an exploded perspective view of the conventional blade assembly in part.
Figure 3:
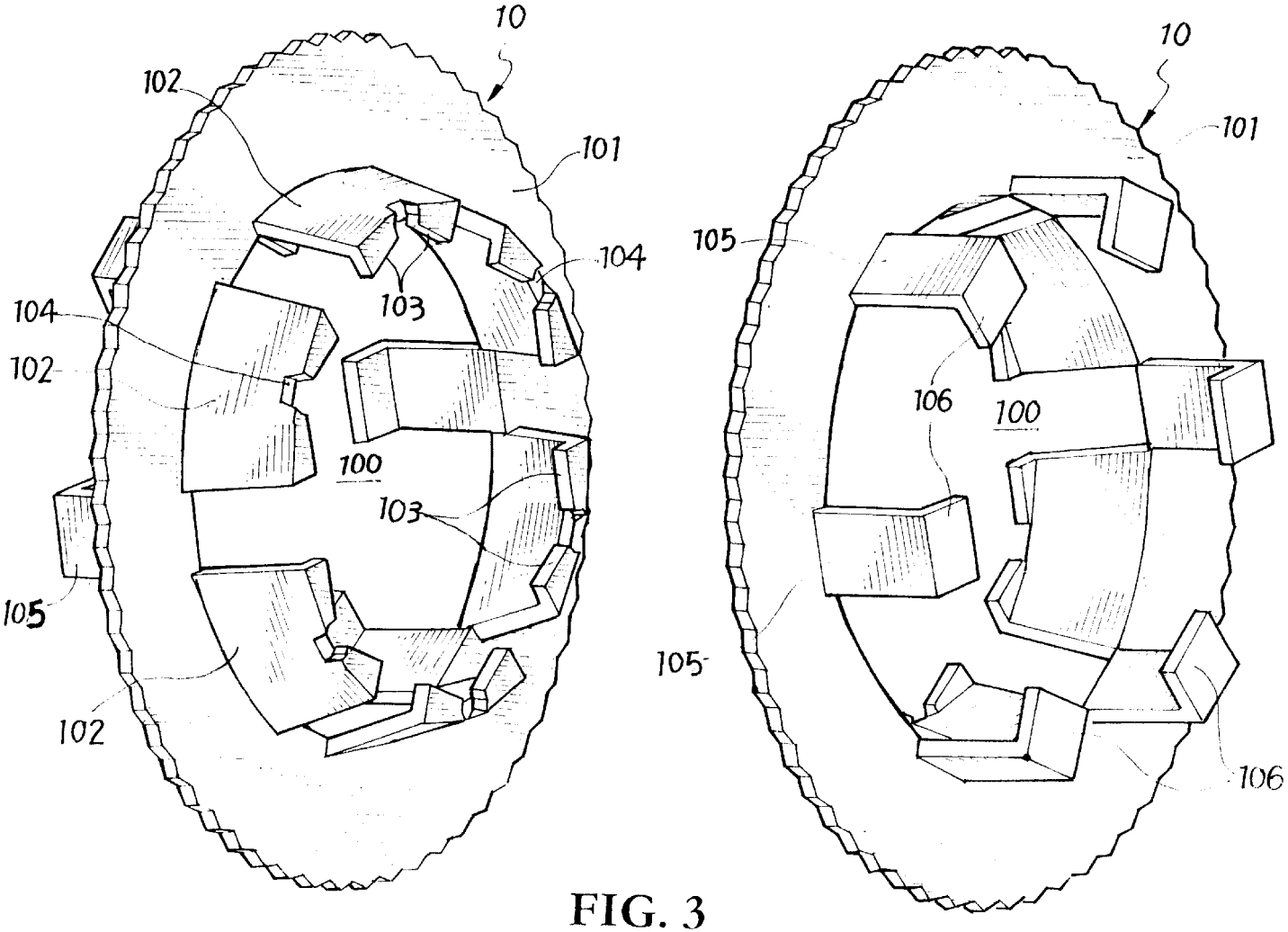
FIG. 3 is a perspective view of a preferred embodiment of the blade assembly of the present invention.
Figure 4:
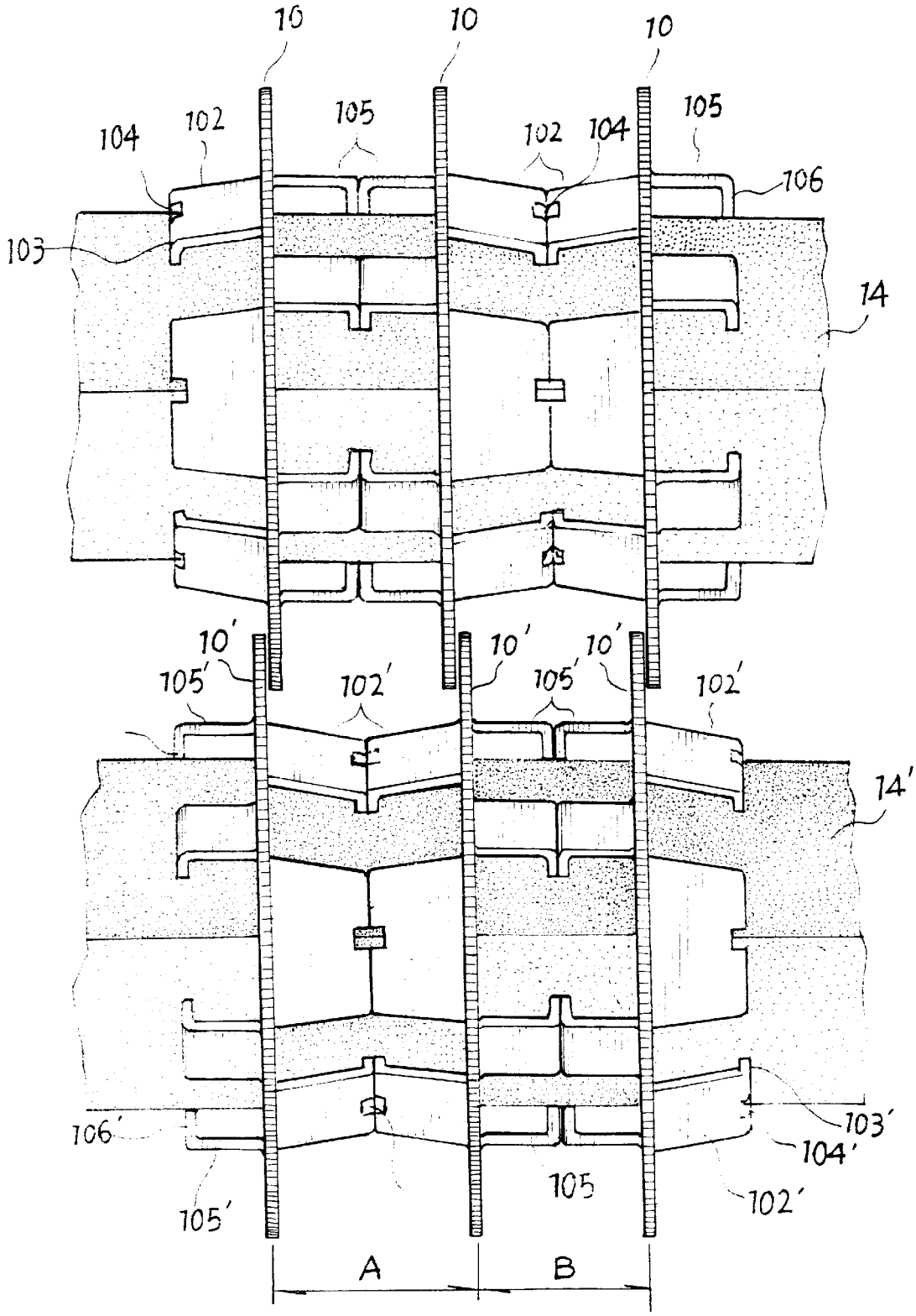
FIG. 4 is an assembled sectional view of the blade assembly of the present invention.
Figure 5:
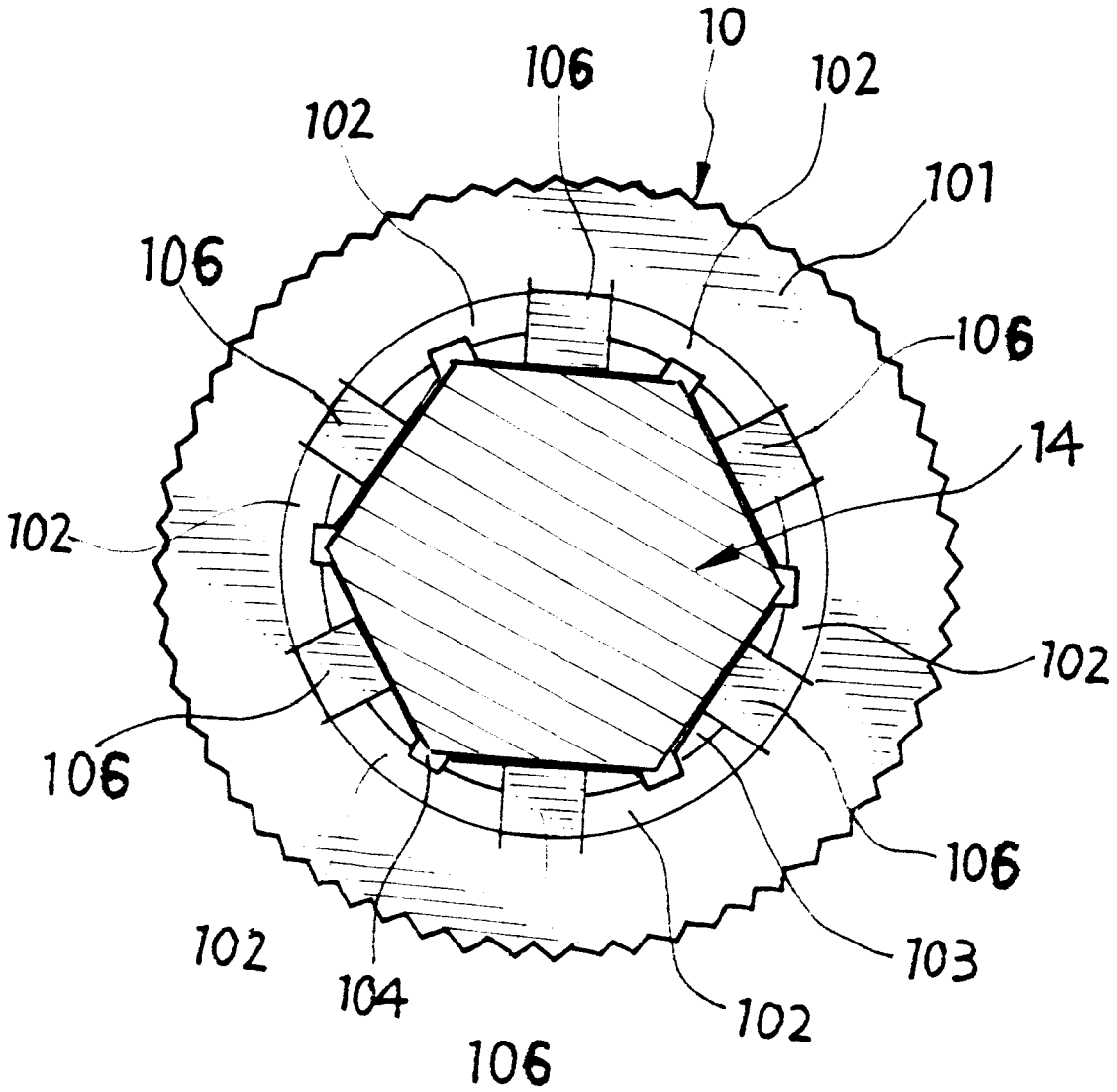
FIG. 5 is a sectional view of the blade assembly in part.

With reference to FIGS. 3, 4 and 5, the present invention is directed to improving blades 10 of a blade assembly of paper shredders. The blade assembly 10 is integrally formed (by casting, forging, or punching, for instance) so that both sides of each blade 10 have a plurality of long projecting plates 102 and short projecting plates 105 extending from the periphery of a central hole of the blade 10. When a plurality of blades 10 are mounted in series on a drive rotary shaft 14 to form a bladed shaft 1, the long projecting plates 102 of adjacent blades 10 will abut against one another to form a long interval, instead of the long interval rings adopted in the prior art. The short projecting plate 104 on the other side of the blade 10 will abut the short projecting plates 104 of an adjacent blade 10 to form a short interval, instead of the short interval rings used in the prior art. Hence, the blades 10 on the bladed shaft are arranged in a repeated, irregular spaced-apart relationship. And when two bladed shafts are stacked such that the upper blades abut against the lower blades, they are ready for shredding.

With reference to FIG. 3, the blade 10 is a generally thin disk having a central hole 100 that allows a polygonal rotary shaft 14 to pass therethrough. A plurality of long projecting plates 102 project from one side of the blade 10 and are so arranged as to correspond to the angular portions 140 of the rotary shaft 14. Each long projecting plate 102 has a rear end bending towards the center of the blade 10 to form a bent engaging portion 103. The engaging portion 103 is centrally provided with a notch 104 adapted to the corresponding angular portion 140 of the rotary shaft 14 (see FIG. 4). On the other side of the blade 10, a plurality of short projecting plates 105 project from the periphery of the central hole 100 to correspond to planar portions 141 of the rotary shaft 14. Each short projecting seat 105 has a rear end bending towards the center to form a retaining portion 106, which is adapted to retain the corresponding planar portion 141 of the rotary shaft 14 (see FIG. 4).

In assembly, the blades 10 are mounted in series on the rotary shaft 14 with the long and short projecting plates 102, 104 of one blade 10 in register with and abutting those of the adjacent blade 10 so that the blades 10 define alternately arranged irregular intervals. In addition, since both of the long and short projecting plates 102, 104 are capable of engaging the rotary shaft 14, the blades 10 can be directly driven by the rotary shaft 14. Two bladed shafts 1 are stacked in the manner shown in FIG. 4 to form a blade assembly that achieves alternate cutting of paper. From the foregoing, it can be seen that the irregularly spaced-apart partition rings employed in the prior art are eliminated in the present invention. Thus, parts cost can be reduced, and assembly efficiency and quality enhanced.

In summary, the present invention provides an improved blade assembly for paper shredders in which the blades are integrally formed to have long projecting plates and short projecting plates on opposed sides thereof, respectively. The blades are arranged in a series on the rotary shaft to form a bladed shaft such that the long and short projecting plates of one blade are in register with those of adjacent blades to replace the conventionally used long and short partition rings. Such a construction eliminates use and costs of parts, enhances assembly efficiency, and reduces trouble rate of blades to thereby prolong the useful life of the blades.

Although the present invention has been illustrated and described with reference to the preferred embodiment thereof, it should be understood that it is in no way limited to the details of such embodiment but is capable of numerous modifications within the scope of the appended claims.

What is claimed is:

1. A blade assembly for paper shredders, comprising a plurality of blades, each of said blades being integrally formed to have a plurality of long projecting plates and a plurality of short projecting plates extending from peripheries of a central hole on both sides thereof, respectively, said plurality of blades being arranged in a series on a drive rotary shaft to form a bladed shaft such that said long projecting plates of a respective one of said blades are in register with and abutting those of an adjacent one of said blades to form a long interval and said short projecting plates of said respective one of said blades are in register with and abutting those of an adjacent one of said blades to form a short interval, whereby said blades define alternately arranged irregular intervals, and when two of said bladed shafts are arranged in a stacked manner, blades of said upper bladed shaft and blades of said lower bladed shaft abut each other and cooperate to achieve alternate cutting of paper.

2. The blade assembly for paper shredders as defined in claim 1, wherein each of said blades is thin disk, and said central hole being adapted for passage of said rotary shaft, said rotary shaft being polygonal, said long projecting plates projecting the periphery of said central hole on one side of said blade to correspond to angular portions of said rotary shaft and have rear ends bending towards said central hole to form engaging portions, each of said engaging portions being centrally provided with a notch for engaging a respective one of said angular portions of said rotary shaft; said short projecting blade projecting from the periphery of said central hole on the other side of said blade to corresponding to planar portions of said rotary shaft and have rear ends bending towards said central hole to form retaining portions for retaining said planer portions of said rotary shaft.

* * * * *